US009199708B2

(12) United States Patent
Shi

(10) Patent No.: US 9,199,708 B2
(45) Date of Patent: Dec. 1, 2015

(54) ATMOSPHERIC WORKING CABIN FOR UNDERWATER OPERATION

(76) Inventor: Xiaoming Shi, Guangdong (CN)

( * ) Notice: Subject to any disclaimer, the term of this patent is extended or adjusted under 35 U.S.C. 154(b) by 0 days.

(21) Appl. No.: 13/990,466

(22) PCT Filed: Sep. 30, 2011

(86) PCT No.: PCT/CN2011/080495

§ 371 (c)(1),
(2), (4) Date: May 30, 2013

(87) PCT Pub. No.: WO2013/044518

PCT Pub. Date: Apr. 4, 2013

(65) Prior Publication Data

US 2014/0209008 A1 Jul. 31, 2014

(51) Int. Cl.

| | |
|---|---|
| ***B63C 11/00*** | (2006.01) |
| ***B63G 8/00*** | (2006.01) |
| ***B63C 11/34*** | (2006.01) |
| ***B63G 8/36*** | (2006.01) |

(52) U.S. Cl.

CPC ..... *B63G 8/001* (2013.01); *B63C 11/34* (2013.01); *B63G 8/36* (2013.01)

(58) Field of Classification Search

CPC ..... B63C 11/36; B63C 11/00; B63C 11/40; B63C 11/34; B63G 8/001; B63G 8/36

USPC ..... 114/314, 313, 335, 342; 405/188, 190, 405/11, 12, 193

See application file for complete search history.

(56) References Cited

U.S. PATENT DOCUMENTS

| | | | | | |
|---|---|---|---|---|---|
| 3,466,880 | A | * | 9/1969 | Elliott | 405/190 |
| 3,473,338 | A | * | 10/1969 | Pearce | 405/188 |
| 4,258,794 | A | * | 3/1981 | Sizer et al. | 166/356 |

FOREIGN PATENT DOCUMENTS

| | | | |
|---|---|---|---|
| CN | 1539702 | A | 10/2004 |
| CN | 1786544 | A | 6/2006 |
| CN | 102126545 | A | 7/2011 |
| DE | 19911858 | A1 | 9/2000 |
| GB | 2041301 | A | 9/1980 |
| WO | 2008009327 | A1 | 1/2008 |

* cited by examiner

*Primary Examiner* — Anthony Wiest
(74) *Attorney, Agent, or Firm* — Tim Tingkang Xia, Esq.; Locke Lord LLP

(57) ABSTRACT

An atmospheric working cabin for underwater operation for implementing operations on the underwater object is provided. The working cabin has two or more layers of cabin bodies, each layer of the cabin body has an interface for butting with the underwater object, the interface of the each layer of the cabin bodies is provided with a flexible gel. A space between an innermost cabin body and an outer cabin body is filled with water, after the working cabin butting with the underwater object, the flexible gel is contacted with the surface of the underwater object, water is drawn out successively from the outside to the inside, whilst air is injected therein, an atmospheric pressure is maintained inside the innermost cabin body, the pressure between the cabin bodies is less than the atmospheric pressure and gradually increases from the outside to the inside.

16 Claims, 6 Drawing Sheets

ATMOSPHERIC WORKING CABIN FOR UNDERWATER OPERATION

FIELD OF THE INVENTION

The present invention relates to an apparatus for underwater operation, and more particularly to an atmospheric working cabin for underwater operation.

BACKGROUND OF THE INVENTION

The object which has been long under water, e.g., a steamship, an oil pipe and an oil tank, to which an abnormal condition occurs, such as a collision, corrosion, underwater organisms and plant attachment, etc., needs local repairmen or replacement timely. Due to underwater work, there is no a simple, reliable and economical method to solve the problem so far. If the object is movable, it can be dragged on the water, e.g. the steamship can be dragged to a dock to be repaired. However, the cost is expensive, and the object is easy to damage during drag. While, if the object is unmovable, such as the oil pipe or the oil tank, there is not a simple, reliable and economical method to perform the operations such as replacement of part of the detachable member, local painting and the likes.

SUMMARY OF THE INVENTION

The aim of the invention is to provide an atmospheric working cabin for underwater operation, which can construct an atmospheric and dry working environment for implementing operations, repairing and maintaining on the underwater object.

The technical solution for solving the technical problem in the present invention is to construct an atmospheric working cabin for underwater operation for implementing operations on the underwater object, wherein, the working cabin has two or more layers of cabin bodies, each layer of the cabin body has an interface for butting with the underwater object, the interface of the each layer of the cabin bodies is provided with a soft gel, there is a hollow structure between two adjacent layers of the cabin bodies.

The working cabin is filled with water before butting with the underwater object. The innermost layer of the cabin body and a space between the innermost layer of the cabin body and its adjacent cabin body are filled with water. After the working cabin butting with the underwater object, the soft gel is brought into contacting with the surface of the underwater object, water between each cabin body and inside the innermost layer of the cabin body is drawn out successively from the outside to the inside, whilst air is injected therein. An atmospheric pressure is maintained inside the innermost cabin body, and pressures between the cabin bodies are less than the atmospheric pressure and gradually increase from the outside to the inside. Due to a pressure difference between the inside and the outside, the soft gel at the interface of each layer of the cabin body contacts tightly with the surface of the underwater object, so as to form a sealing between the underwater object and the interface.

In the atmospheric working cabin for underwater operation of the present invention, the working cabin consists of an upper part and a lower part butting with each other, the underwater object is a tubular object running through the working cabin or with one end extending into the working cabin.

In the atmospheric working cabin for underwater operation of the present invention, the working cabin further comprises pipelines for discharging water out of and injecting water into the working cabin, and pipelines for supplying air into and discharging air out of the working cabin.

In the atmospheric working cabin for underwater operation of the present invention, The pipelines comprise an outer tube, an outer layer water pipe located inside the outer tube for water discharging and injection between the cabin bodies, an inner layer water pipe for water discharging and injection inside the innermost layer of the cabin body, an inner layer air pipe for air discharging and supplying inside the innermost layer of the cabin body, and a cable for supplying power to the cabin bodies. The joints between the outer tube and the respective cabin body are provided with a sealing gel.

In the atmospheric working cabin for underwater operation of the present invention, the working cabin further comprises a pipeline fixing component for fixing the pipelines.

In the atmospheric working cabin for underwater operation of the present invention, the pipeline fixing component comprises a clamp for fixing the pipelines, and a magnetic chuck for fixing the clamp. The magnetic chuck is provided with a magnetic switch.

In the atmospheric working cabin for underwater operation of the present invention, the pipeline fixing component comprises a clamp for fixing the pipelines, a colloidal chuck for fixing the clamp, and a suction pipe connected with the colloidal chuck.

In the atmospheric working cabin for underwater operation of the present invention, the working cabin further comprises a working cabin fixing component for fixing the working cabin.

In the atmospheric working cabin for underwater operation of the present invention, the working cabin fixing component comprises a hanging piece, a spring and a magnetic chuck, wherein, the hanging piece is located on the outermost layer of cabin body of the working cabin, one end of the spring is fixed on the hanging piece, and the other end of the spring is fixed on the magnetic chuck provided with a magnetic switch.

In the atmospheric working cabin for underwater operation of the present invention, the working cabin fixing component comprises a hanging piece, a spring, a colloid chuck and a suction pipe, wherein, the hanging piece is located on the outermost layer of cabin body of the working cabin, one end of the spring is fixed on the hanging piece, and the other end of the spring is fixed on the colloid chuck. The suction pipe is connected with the colloid chuck for drawing water out of and injecting water into the colloid chuck.

In the atmospheric working cabin for underwater operation of the present invention, inside the innermost layer of cabin body of the working cabin, a sealed toolbox is provided.

The implementation of the atmospheric working cabin for underwater operation of the present invention has the following beneficial effects. The working cabin has two or more layers of cabin bodies, then a plurality of pressure difference tight adsorption sealing structures may be formed between multiple layers of cabin bodies, so as to prevent adsorption release caused by a sudden change of the pressure difference between any one layer of the cabin body and the other for an expected reason, which may cause sudden change of the pressure difference of the working cabin, thereby affecting the safety of the working personnel inside the working cabin.

BRIEF DESCRIPTION OF THE DRAWINGS

The present invention is described with reference to the accompanying drawings.

DETAILED DESCRIPTION OF THE PREFERRED EMBODIMENT

Figure 1:
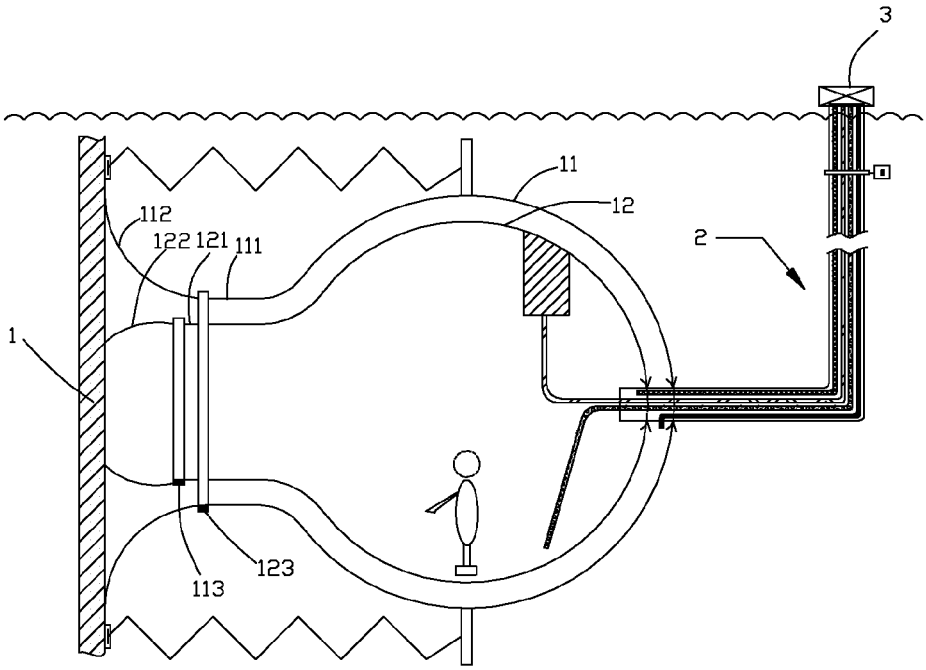
FIG. 1 is a schematic diagram of the working cabin for underwater operation of the first embodiment of the invention.

In the present invention, a working cabin with two or more layers of cabin body structure is constructed based on the principle that a rigid body and a flexible body can be mutually and closely adsorbed together by generating a pressure difference between the surfaces thereof. The working cabin can be used to perform various operations on the underwater object in a normal environment. The working cabin according to the present invention has a two or more layers of cabin body structure. Each layer of the cabin body has an interface provided with a soft gel, such as soft rubber, silica gel, etc. Such soft gel may be brought into contacting with the surface of the object to be operated. When the underwater object needs operation, the working personnel in wetsuit, necessary tools and materials are placed in the innermost layer of the working cabin in prior. Then the working cabin is sunk to the surface of the object to be operated. After the working cabin is fixed by a fixing component, the water located between the plurality of cabin bodies of the working cabin is discharged out gradually. As a result, a pressure difference is generated between the inner and outer sides of the soft gel, and then the soft gel and the object to be operated can be mutually and closely adsorbed together by the formed pressure difference between the surfaces thereof. Thereby the sealing between the underwater object and the interface is formed. Subsequently, the water is discharged out of the innermost layer of the cabin body gradually, whilst air is injected into it, so as to make the pressure in the innermost layer of the cabin body reaching an atmospheric environment same as that on the ground, i.e. 1 atm atmospheric environment. The close absorbing state between the soft gels at the interface of the outer layer cabin body as well as the normal circumstance inside the working cabin may be maintain in real time by the working personnel on the ground utilizing a built-in pressure gauge and a monitoring device of the working cabin. The working personnel on the ground may keep real-time communication with the personnel inside the working cabin. The working personnel inside the working cabin may operate various tools and materials stored in the sealed tool box by use of cable connected to the ground, so as to operate the object under normal circumstance. After the completion of the operation, the water is injected into the innermost layer of the cabin body whilst the air is discharged out of it. After water is filled, the in-vivo pressure in the innermost layer of the cabin body is equivalent to the water pressure outside of the working cabin and the object to be operated. Water is subsequently injected between each layer of the cabin body and the other gradually, so as to eliminate the pressure difference between each layer of the cabin body and the other as well as between each layer of the cabin body and the peripheral water gradually. Finally, the fixing component is removed, and then the working cabin is towed out of water.

The difference between the working cabins with two and more layers of cabin bodies lies in that a plurality of pressure difference tight adsorption sealing structures may be formed between multiple layers of cabin bodies, so as to prevent adsorption release caused by a sudden change of the pressure difference between any one layer of the cabin body and the other for an expected reason, which may cause sudden change of the pressure difference of the working cabin, thereby affecting the safety of the working personnel inside the working cabin.

The principle of the invention is explicated above. In order to understand the technical feature, purposes and effects of the present invention more clearly, the present invention is more specifically described in the following paragraphs by reference to the drawings attached only by way of example.

Figure 2:
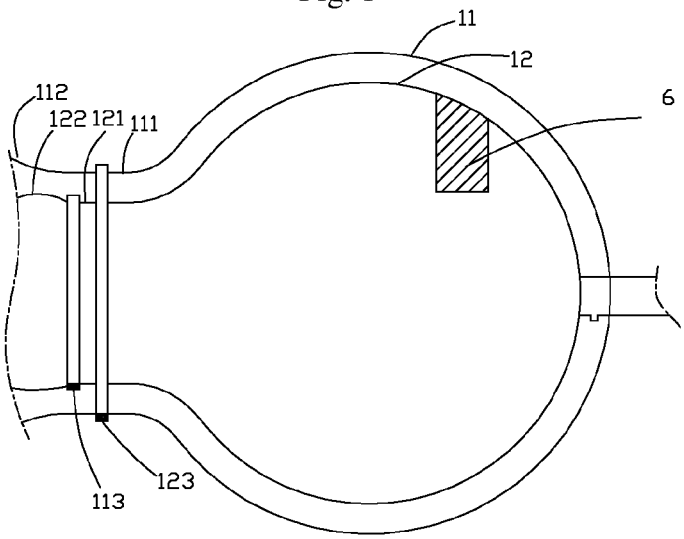
FIG. 2 is a schematic diagram of the cabin body of the working cabin for underwater operation of the first embodiment of the invention.

FIG. 1 and FIG. 2 show an atmospheric working cabin for underwater operation according to the first embodiment of the present invention, wherein, the embodiment is a local surface adsorption typed working cabin. The working cabin with a two-layered cabin body structure has an outer cabin body 11, an inner cabin body 12 and a hollow structure between the outer cabin body 11 and the inner cabin body 12. The outer cabin body 11 and the inner cabin body 12 are respectively provided with interfaces 111, 121, wherein, the interface 111 of the outer cabin body 11 is located on the periphery of the interface 121 of the inner cabin body 12. Both of the interfaces 111, 121 are provided with soft gels 112, 122, wherein, the soft gel 112 on the interface 111 of the outer cabin body 11 is substantially trumpet shaped, while the soft gel 122 on the interface 121 of the inner cabin body 12 is substantially inverse trumpet shaped. The soft gels 112, 122 may be silica sleeve or rubber sleeve which is soft and elastic, and easily adsorbed on the other objects. The soft gels 112, 122 are respectively fixed on the interfaces 111, 121 by buckle-type hoop 113, 123.

Before butted the underwater object 1, the working cabin is filled with water, which means the inside of the inner cabin body 12 and the space between the outer cabin body 11 and the inner cabin body 12 are filled with water. The working cabin is subsequently butted the underwater object 1, making the soft gels 112, 122 contact with the surface of the underwater object. And then the water discharge and the air injection are both performed on the cabin body. Firstly, the water between the outer cabin body 11 and the inner cabin body 12 is discharged out, so as to generate a pressure difference between the inside and outside of the soft gels 112, 122 respectively. As such, the soft gels 112, 122 may be absorbed tightly on the surface of underwater object due to such differential pressure, and sealings between the interfaces 111, 121 and the surface of the underwater object 1 are formed. During the discharge of the water between the outer cabin body 11 and the inner cabin body 12, some air may be injected therein. However, the pressure between the outer cabin body 11 and the inner cabin body 12 is smaller than atmospheric pressure. The water inside the inner cabin body 12 is discharged out, whilst the air is injected into it, so as to keep the inner cabin body 12 in the atmospheric pressure state. As the pressure inside the inner cabin body 12 is larger than that between the outer cabin body 11 and the inner cabin body 12, a pressure difference is also formed between the inside and outside of the soft gel 122.

Figure 3:
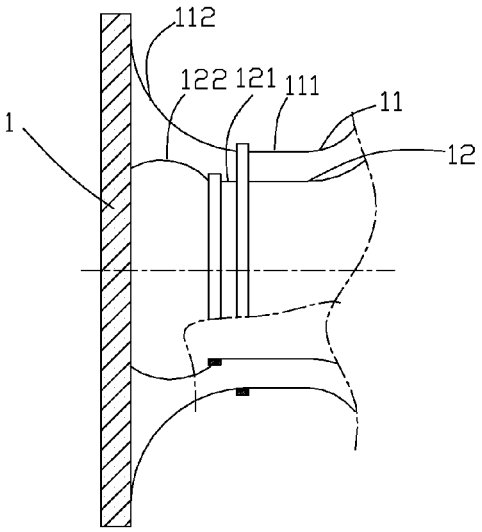
FIG. 3 is a schematic diagram of the working cabin for underwater operation of the first embodiment of the invention cooperated with a plane object.
Figure 4:
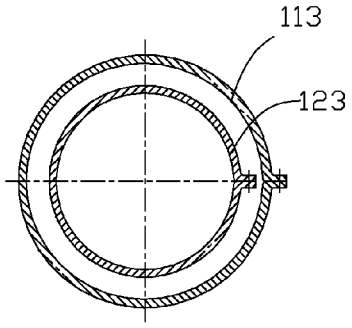
FIG. 4 is a view of the end surface of the interface of the working cabin for underwater operation shown in FIG. 3.
Figure 5:
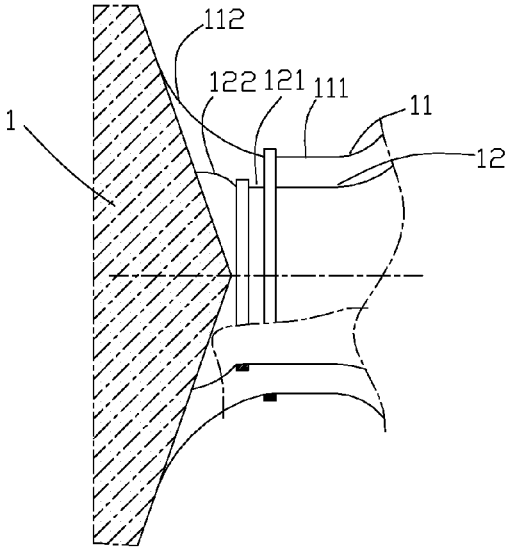
FIG. 5 is a schematic diagram of the working cabin for underwater operation of the first embodiment of the invention cooperated with a conical object.
Figure 6:
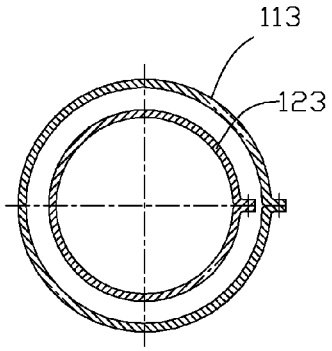
FIG. 6 is a view of the end surface of the interface of the working cabin for underwater operation shown in FIG. 5.

FIGS. 3 and 4 are schematic diagrams showing the working cabin absorbed on a plat surface. FIGS. 5 and 6 are schematic diagrams showing the working cabin absorbed on a conical surface. Due to its good absorption ability, the soft gel can be absorbed on various types of surfaces when there is a pressure difference.

Figure 7:
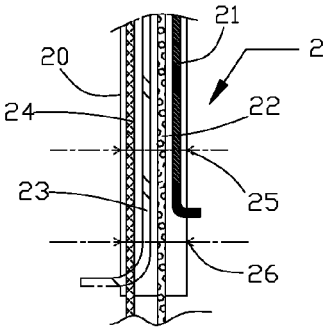
FIG. 7 is a schematic diagram of the pipelines of the working cabin for underwater operation of the first embodiment of the invention.

Referring to FIGS. 1 and 7, in the present embodiment, in order to facilitate the water discharging and injection, and the air discharging and injection of the working cabin respectively, the working cabin is provided with pipelines 2 for the water discharging and injection as well as the air discharging and injection. The pipelines 2 comprise an outer tube 20, an outer layer water pipe 21 located inside the outer tube 20 for water discharging and injection between the outer cabin body 11 and the inner cabin body 12, an inner layer water pipe 22 for water discharging and injection inside the inner cabin body 12, an inner layer air pipe 23 for air discharging and supplying inside the inner cabin body 12, and a cable 24 for supplying power to the inner cabin body 12. The joint between the outer tube 20 and the outer cabin body 11, and that between the outer tube 20 and the inner cabin body 12 are provided with sealing gels 25, 26 respectively. At the end of the pipelines 2 is provided with a peripheral control device 3 for detecting and controlling the state inside the working cabin.

Figure 8:
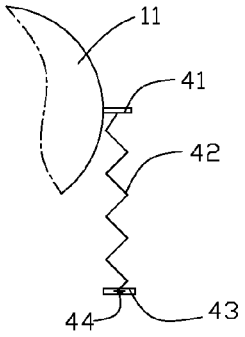
FIG. 8 is a schematic diagram of the working cabin fixing component in the first form of the working cabin for underwater operation of the first embodiment of the invention.
Figure 9:
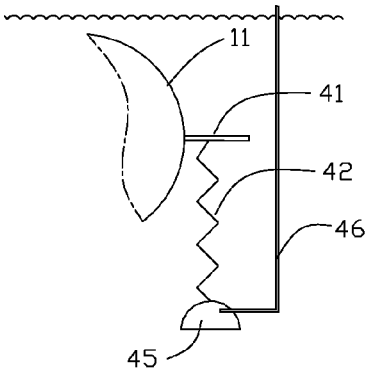
FIG. 9 is a schematic diagram of the working cabin fixing component in the second form of the working cabin for underwater operation of the first embodiment of the invention.

Referring to FIGS. 1 and 8, in order to prevent the working cabin from shaking during operation thus affecting the state inside the working cabin, the working cabin is further provided with a working cabin fixing component. FIG. 1 and FIG. 8 show one form of the working cabin fixing component which comprises a hanging piece 41, a spring 42 and a magnetic chuck 43, wherein, the hanging piece 41 is located on the outer cabin body 11 of the working cabin. One end of the spring 42 is fixed on the hanging piece 41 and the other end is fixed on the magnetic chuck 43. In order to facilitate taking off the magnetic chuck 43, the magnetic chuck 43 is further provided with a magnetic switch 44. Such form of working cabin fixing component is adapted to the object to be operated made of steel material. For the object to be operated made of non-steel material, another form of working cabin fixing component can be adopted. As shown in FIG. 9, such working cabin fixing component comprises a hanging piece 41, a spring 42, a colloid chuck 45 and a suction pipe 46. The colloid chuck 45 is absorbed on the underwater object due to the pressure difference generated by the suction pipe 46 via discharging the water inside the colloid chuck 45.

Figure 10:
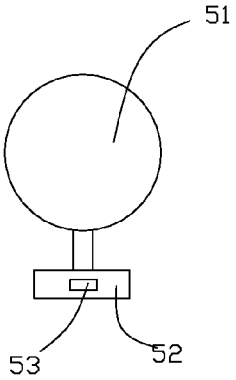
FIG. 10 is a schematic diagram of the pipeline fixing component in the first form of the working cabin for underwater operation of the first embodiment of the invention.
Figure 11:
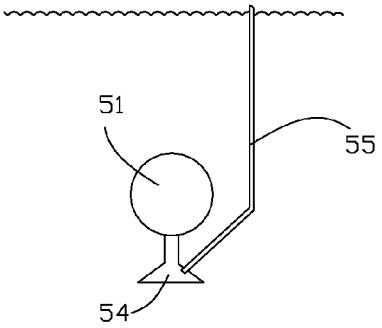
FIG. 11 is a schematic diagram of the pipeline fixing component in the second form of the working cabin for underwater operation of the first embodiment of the invention.

During underwater operation, it is also needed to fix the pipelines 2 to prevent the pipelines 2 from shifting occurred by water flow. The pipelines 2 may be fixed by a pipeline fixing component. As shown in FIG. 10, one form of the pipeline fixing component comprises a clamp 51 for fixing the pipelines 2, and a magnetic chuck 52 for fixing the clamp 51. The magnetic chuck 52 is provided with a magnetic switch 53. Such form of the pipeline fixing component is adapted to the object to be operated made of steel material. For the object to be operated made of non-steel material, another form of pipeline fixing component can be adopted. As shown in FIG. 11, such pipeline fixing component comprises a clamp 51 for fixing the pipeline 2, a colloidal chuck 54 for fixing the clamp 51, and a suction pipe 55 connected with the colloidal chuck 54. In present embodiment, the suction pipe 46 is used to discharge the water inside the colloid chuck 45 to generate the pressure difference.

Referring to FIGS. 1 and 2, in order to facilitate the storage of the tools, a sealing toolbox 6 may be provided inside the inner cabin body 12. The operation tools may be stored inside the sealing toolbox 6. When the atmospheric environment is formed inside the inner cabin body 12, the sealing toolbox 6 can be opened and subsequently the tools can be taken out for operation.

Figure 12:
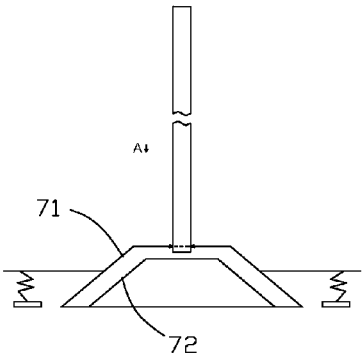
FIG. 12 is a schematic diagram of the multilayer colloid chuck of the working cabin for underwater operation of the first embodiment of the invention.
Figure 13:
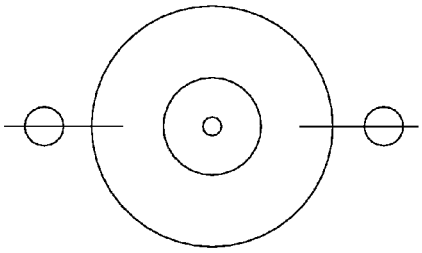
FIG. 13 is a view of FIG. 12 in the direction of A.

If the site needs repeated operations, e.g. painting, an auxiliary cover chuck is provided in the present invention. As shown in FIGS. 12 and 13, the auxiliary cover chuck is with two or more layers of structure, similar to the structure of the working cabin. In the present embodiment, the auxiliary cover chuck comprises an outer chuck 71 and an inner chuck 72. The inner chuck 72 may be full covering the site to be operated, and maintain in a normal state. The inner chuck 72 and the outer chuck 71 are always absorbed tightly with the operation surface. The adsorption sate will be released at the operation, so as to keep operation part requiring repeatedly operations always under a normal state.

The working mode of the local surface adsorption typed working cabin comprises the following steps.

1. The operator determines the material of the object to be operated, the shape and size of the surface requiring operation, and operation items, thereby to adopt different working cabin fixing components, soft gels and interfaces, tools, and operation materials, wherein, the tools are arranged in the sealing toolbox built in the working cabin.

2. The operation personnel with diving qualification are in the working cabin.

3. The working cabin is put into water, and the interface of the working cabin is aligned with the local operation site by the diver.

4. The working cabin is substantially fixed on the object to be operated by a working cabin fixing component.

5. The water between the outer cabin body and the inner cabin body is drawn out gradually, so as to generate a pressure difference between the soft gel of the interface of the outer cabin body and the external water. The pressure between the outer cabin body and the inner cabin body should be less than 1 atm. As such, the working cabin is completely absorbed on the object to be operated. The air pumping is performed in real time based on the pressure gauge data between the outer cabin body and the inner cabin body displayed by a monitor, thereby to ensure the outer cabin body is always under a tight adsorption state.

6. The water is drawn out of the inner cabin body, whilst the air is injected therein. According to the indication of a barometer, the air is supplied and alternated in real time, so as to keep the environment inside the inner cabin body same with the air environment on the ground, i.e. 1 atm of the air environment.

7. The operation personnel takes off the diving suit, and open the sealing toolbox to take out the tools, thereby to carry out various operations on the object to be operated after the power supply is switched on.

8. If the site to be operated requiring repeatedly operations such as paint, an auxiliary cover chuck may be utilized to implement covering, so as to keep the operation site requiring repeatedly operations always under a normal state.

9. After the operation is completed, the operation personnel takes on the diving suit and indicates the personnel on the ground through communication cables to inject water into the working cabin and simultaneously draw air out, so as to make the pressure inside the working cabin consistent with the water pressure periphery of the container and the object to be operated, to release the absorption of the outer cabin body, to remove the working cabin fixing component, and to retract the working cabin.

Figure 14:
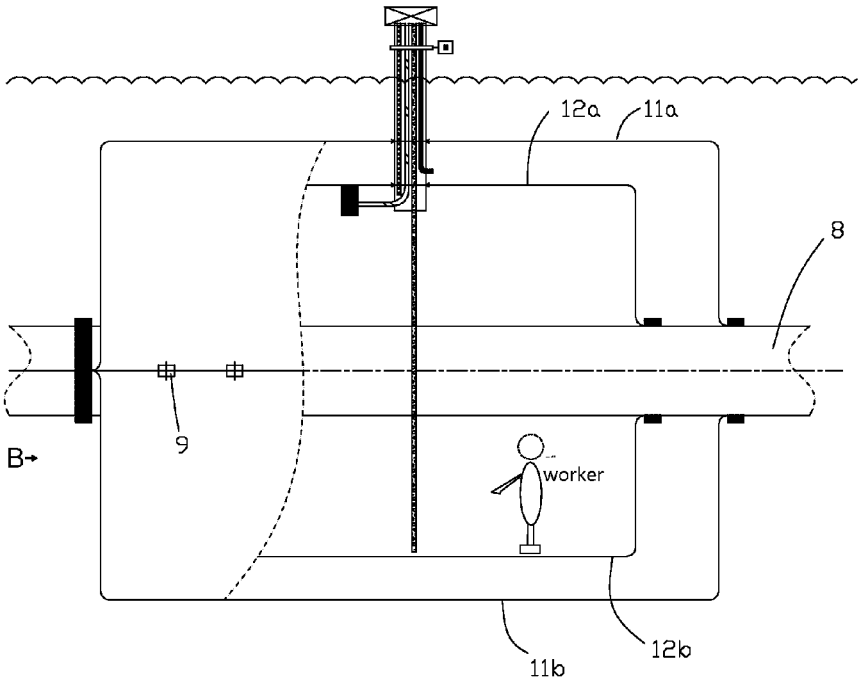
FIG. 14 is a schematic diagram of the working cabin for underwater operation of the second embodiment of the invention.
Figure 15:
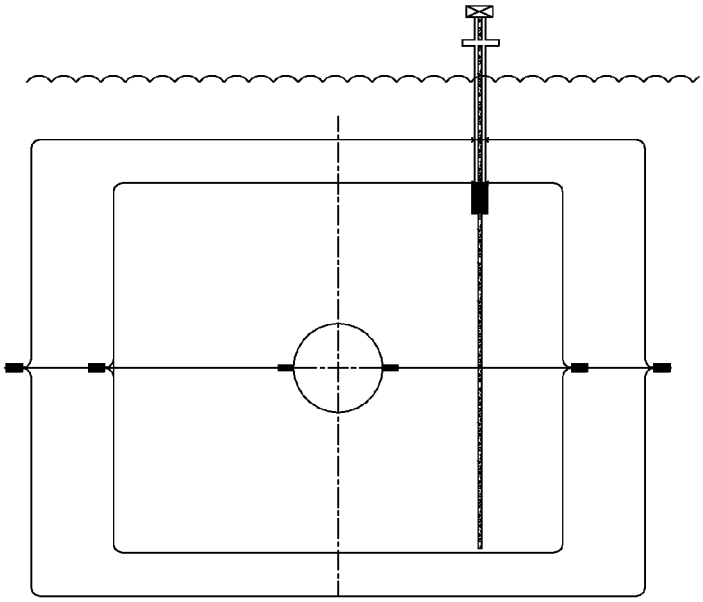
FIG. 15 is a view of FIG. 14 in the direction of B.

In addition to the local surface adsorption typed working cabin, the present invention also provides a local integral adsorption typed working cabin for pipeline operation. FIG. 14 and FIG. 15 show the second embodiment of the atmospheric working cabin for underwater operation in the present invention. In the embodiment, the working cabin comprises an upper half part and a lower half part with two layers of cabin body structure respectively. The upper half part comprises an upper half outer cabin body 11*a* and an upper half inner cabin body 12*a*, the lower half part comprises an lower half outer cabin body 11*b* and an lower half inner cabin body 12*b*. The pipeline 8 runs through the working cabin. The soft gel is provided at the interfaces respectively joining the upper and the lower half outer cabin bodies and the upper and the lower half inner cabin bodies with the pipeline 8. The soft gel is absorbed on the surface of the pipeline 8 under the action of the pressure difference to form sealing. The principle is the same as that in the first embodiment, and will not be described in detail herein. The upper half part and the lower half part of the working cabin may be fixed by a locking tube fastener 9. The rest structures are similar with that in the first embodiment respectively.

Figure 16:
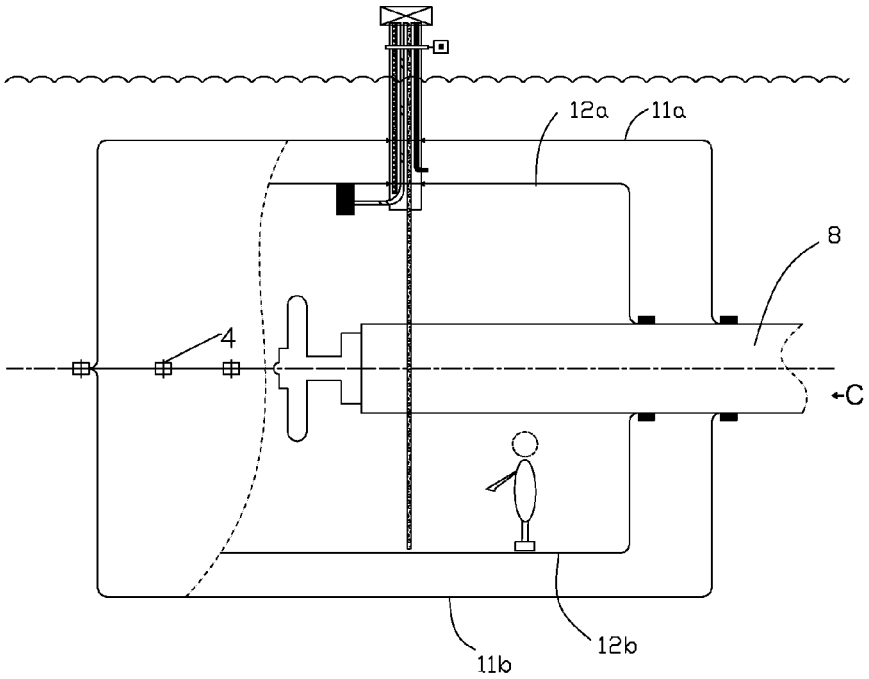
FIG. 16 is a schematic diagram of the working cabin for underwater operation of the third embodiment of the invention.
Figure 17:
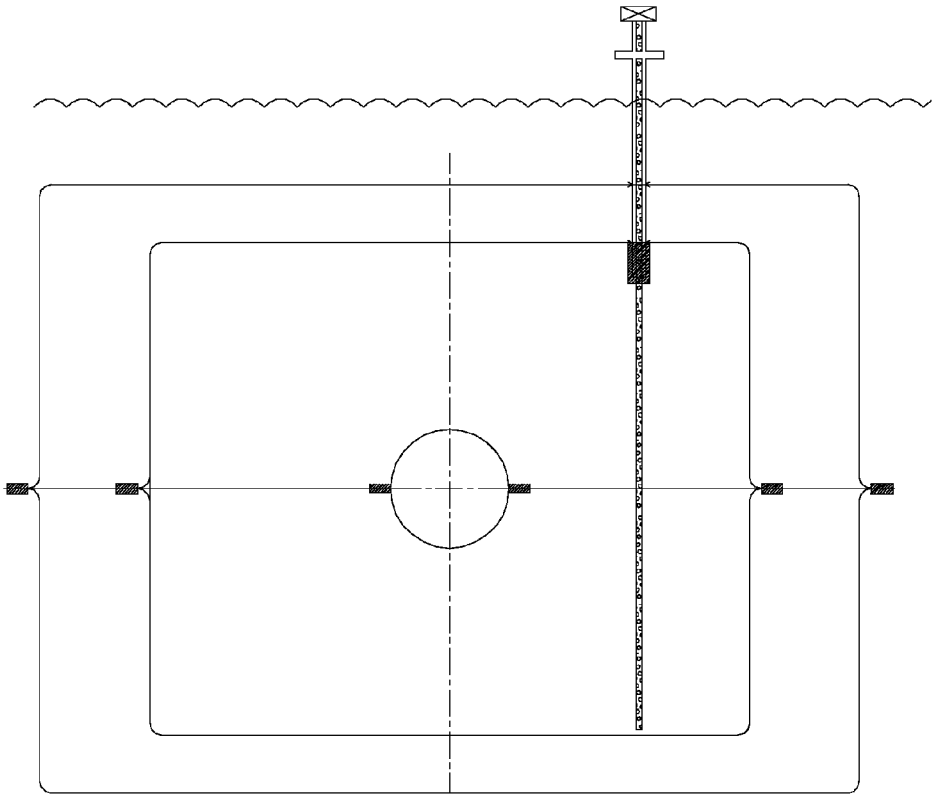
FIG. 17 is a view of FIG. 16 in the direction of C.

FIG. 16 and FIG. 17 show the third embodiment of the atmospheric working cabin for underwater operation in the present invention. Unlike the second embodiment, herein the working cabin is used for repairing the end of the pipeline 8, wherein, it just needs the end of the pipeline 8 extending into the working cabin. Compared with the second embodiment, only one interface is omitted, and the rest structures are similar.

The working mode of the local integral adsorption typed working cabin comprises the following steps.

1. The operator determines the respective outer diameter of the object to be operated, and the operation items, so as to adopt the interfaces with different outer diameter, tools and operation materials, wherein, the tools are arranged in the toolbox built in the working cabin.

2. The operation personnel with diving qualification are in the working cabin.

3. The working cabin is put into water. The upper half part and the lower half part of the working cabin are aligned with local site of the object to be operated by an external diver, and then butted therewith.

4. An inner fastener is fastened by the external diver firstly, and then the locking tube fastener is fastened.

5. The water between the outer cabin body and the inner cabin body is drawn out gradually, so as to generate a pressure difference between the soft gel of the interface of the outer cabin body and the external water. The pressure between the outer cabin body and the inner cabin body should be less than 1 atm. As such, the working cabin is completely absorbed on the object to be operated. The air pumping is performed in real time based on the pressure gauge data between the outer cabin body and the inner cabin body displayed by a monitor, thereby to ensure the outer cabin body is always under a tight adsorption state.

6. The water is drawn out of the inner cabin body, whilst the air is injected therein. According to the indication of a barometer, the air is supplied and alternated in real time, so as to keep the environment inside the inner cabin body same with the air environment on the ground, i.e. 1 atm of the air environment.

7. The operation personnel takes off the diving suit, and opens the sealing toolbox to take out the tools, thereby to carry out various operations on the object to be operated after the power supply is switched on.

8. If the site to be operated requiring repeatedly operations such as paint, an auxiliary cover chuck may be utilized to implement covering, so as to keep the operation site requiring repeatedly operations always under a normal state.

9. After the operation is completed, the operation personnel takes on the diving suit and indicates the personnel on the ground through communication cables to inject water into the working cabin and simultaneously draw air out, so as to make the pressure inside the working cabin consistent with the water pressure periphery of the container and the object to be operated, to release the absorption of the outer cabin body, to remove the locking tube fastener, and to retract the working cabin.

The atmospheric working cabin for underwater operation in the present invention is not only used for working under water, but also for working under other liquid medium.

The working cabin in the present invention has two or more layers of cabin bodies. A plurality of pressure difference tight adsorption sealing structures may be formed between multiple layers of cabin body, so as to prevent adsorption release caused by a sudden change of the pressure difference between any one layer of the cabin body and the other for an expected reason, which may cause sudden change of the pressure difference of the working cabin, thereby affecting the safety of the working personnel inside the working cabin. In addition, by controlling the pressure difference between each layer of the cabin body and the other, the working cabin of the present invention adapts to the operations of various depths. Even if for semi-submersible and in shallow water, an absorption sealing can be formed by the pressure difference generated between outside and inside of the soft gel.

While the invention has been described in terms of various specific embodiments, but the present invention is not limited to the specific embodiments described above. The above specific embodiments are shown only schematically, instead of limiting. Those skilled in the art will recognize that the invention can be practiced with modification within the spirit and scope of the claims.

The invention claimed is:

1. An atmospheric working cabin for underwater operation for implementing operations on an underwater object, comprising:

two or more layers of cabin bodies, wherein each layer of cabin body has an interface for butting with the underwater object, the interface of each layer of the cabin bodies is provided with a flexible gel, there is a hollow structure between two adjacent layers of the cabin bodies;

wherein the working cabin is filled with water before butting with the underwater object, a space between an innermost cabin body and an outer cabin body adjacent to the innermost cabin body is filled with water, after the working cabin butting with the underwater object, the flexible gel is brought into contact with a surface of the underwater object, water between each layer of cabin body and water inside the innermost cabin body is drawn out successively from the outside to the inside, whilst air is injected therein, an atmospheric pressure is maintained inside the innermost cabin body, pressures between the cabin bodies are less than the atmospheric pressure and gradually increases from the outside to the inside, as there exists a pressure difference between the inside and the outside of the flexible gel of the interface of each layer of cabin body, after the interface contacts tightly with the surface of the underwater object, a sealing between the underwater object and the interface is formed.

2. The atmospheric working cabin for underwater operation of claim 1, wherein, the working cabin further comprises an upper part and a lower part butting with each other, the underwater object is tubular, the underwater object runs through the working cabin or one end of the underwater object extends into the working cabin.

3. The atmospheric working cabin for underwater operation of claim 2, wherein, the working cabin further comprises pipelines for discharging water out of and injecting water into the working cabin, and pipelines for supplying air into and discharging air from the working cabin.

4. The atmospheric working cabin for underwater operation of claim 3, wherein, the pipelines comprise an outer tube, an outer layer water pipe located inside the outer tube for water discharging and injection between the cabin bodies, an inner layer water pipe for water discharging and injection inside the innermost cabin body, an inner layer air pipe for air discharging and supplying inside the innermost cabin body, and a cable for supplying power to the cabin bodies, and joints between the outer tube and respective cabin body are provided with a sealing gel.

5. The atmospheric working cabin for underwater operation of claim 3, wherein, the working cabin further comprises a pipeline fixing component for fixing the pipeline.

6. The atmospheric working cabin for underwater operation of claim 5, wherein, the pipeline fixing component comprises a clamp for fixing the pipelines, and a magnetic chuck for fixing the clamp, wherein, the magnetic chuck is provided with a magnetic switch.

7. The atmospheric working cabin for underwater operation of claim 5, wherein, the pipeline fixing component comprises a clamp for fixing the pipelines, a colloidal chuck for fixing the clamp, and a suction pipe connected with the colloidal chuck.

8. The atmospheric working cabin for underwater operation of claim 1, wherein, the working cabin further comprises pipelines for discharging water out of and injecting water into the working cabin, and pipelines for supplying air into and discharging air from the working cabin.

9. The atmospheric working cabin for underwater operation of claim 8, wherein, the pipelines comprise an outer tube, an outer layer water pipe located inside the outer tube for water discharging and injection between the cabin bodies, an inner layer water pipe for water discharging and injection inside the innermost cabin body, an inner layer air pipe for air discharging and supplying inside the innermost cabin body, and a cable for supplying power to the cabin bodies, and joints between the outer tube and respective cabin body are provided with a sealing gel.

10. The atmospheric working cabin for underwater operation of claim 8, wherein, the working cabin further comprises a pipeline fixing component for fixing the pipeline.

11. The atmospheric working cabin for underwater operation of claim 10, wherein, the pipeline fixing component comprises a clamp for fixing the pipelines, and a magnetic chuck for fixing the clamp, wherein, the magnetic chuck is provided with a magnetic switch.

12. The atmospheric working cabin for underwater operation of claim 10, wherein, the pipeline fixing component comprises a clamp for fixing the pipelines, a colloidal chuck for fixing the clamp, and a suction pipe connected with the colloidal chuck.

13. The atmospheric working cabin for underwater operation of claim 1, wherein, the working cabin further comprises a working cabin fixing component for fixing the working cabin.

14. The atmospheric working cabin for underwater operation of claim 13, wherein, the working cabin fixing component comprises a hanging piece, a spring and a magnetic chuck, wherein, the hanging piece is located on an outermost layer of cabin body of the working cabin, one end of the spring is fixed on the hanging piece, and the other end of the spring is fixed on the magnetic chuck provided with a magnetic switch.

15. The atmospheric working cabin for underwater operation of claim 13, wherein, the working cabin fixing component comprises a hanging piece, a spring, a colloid chuck and a suction pipe, wherein, the hanging piece is located on an outermost layer of cabin body of the working cabin, one end of the spring is fixed on the hanging piece, and the other end of the spring is fixed on the colloid chuck, the suction pipe is connected with the colloid chuck for drawing water out of the colloid chuck and injecting water therein.

16. The atmospheric working cabin for underwater operation of claim 1, wherein, inside the innermost cabin body of the working cabin is provided with a sealed toolbox.

* * * * *